US010519969B2

(12) United States Patent
Lin et al.

(10) Patent No.: US 10,519,969 B2
(45) Date of Patent: Dec. 31, 2019

(54) CENTRIFUGAL FAN

(71) Applicant: ASUSTeK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 125 days.

(21) Appl. No.: 15/841,499

(22) Filed: Dec. 14, 2017

(65) Prior Publication Data

US 2018/0187693 A1 Jul. 5, 2018

(30) Foreign Application Priority Data

Dec. 30, 2016 (CN) ..... 2016 2 1481042 U

(51) Int. Cl.

| | |
|---|---|
| ***F04D 29/30*** | (2006.01) |
| ***F04D 29/66*** | (2006.01) |
| ***F04D 29/28*** | (2006.01) |
| *F04D 29/42* | (2006.01) |

(52) U.S. Cl.

CPC ..... *F04D 29/30* (2013.01); *F04D 29/281* (2013.01); *F04D 29/667* (2013.01); *F04D 29/4226* (2013.01)

(58) Field of Classification Search

None

See application file for complete search history.

(56) References Cited

U.S. PATENT DOCUMENTS

| | | | | |
|---|---|---|---|---|
| 5,296,769 | A * | 3/1994 | Havens | A47L 5/22 310/58 |
| 2005/0260072 | A1* | 11/2005 | Hsu | F04D 29/0563 415/199.6 |
| 2011/0063799 | A1* | 3/2011 | Takahasi | F04D 25/08 361/695 |
| 2011/0247789 | A1* | 10/2011 | Yu | F04D 25/0613 165/121 |
| 2011/0250065 | A1* | 10/2011 | Liang | F04D 25/0613 415/212.1 |
| 2012/0251323 | A1* | 10/2012 | Chiu | F01D 5/02 416/198 R |
| 2013/0195638 | A1* | 8/2013 | Huang | F04D 25/0613 415/203 |
| 2016/0003258 | A1* | 1/2016 | Wu | F04D 25/0613 415/203 |

FOREIGN PATENT DOCUMENTS

| | | | |
|---|---|---|---|
| CN | 2518773 | Y | 10/2002 |
| CN | 100455822 | C | 1/2009 |

* cited by examiner

*Primary Examiner* — Michael Lebentritt
(74) *Attorney, Agent, or Firm* — McClure, Qualey & Rodack, LLP

(57) ABSTRACT

A centrifugal fan is provided. The centrifugal fan comprises a housing and an impeller. The housing includes an upper cover and a lower cover. The impeller is configured in the housing. The impeller includes a hub, a plurality of blades and an air guiding structure. The hub is pivoted on the lower cover and rotates around a rotation axis. The rotation axis extends in the axial direction. The blades are connected to a peripheral surface of the hub and configured between the upper cover and the lower cover. The air guiding structure is connected to the blades. An angle between the air guiding structure and the rotation axis increases along with a distance in the direction away from the hub.

9 Claims, 9 Drawing Sheets

CENTRIFUGAL FAN

CROSS-REFERENCE TO RELATED APPLICATION

This application claims the priority benefit of CN application serial No. 201621481042.2, filed on Dec. 30, 2016. The entirety of the above-mentioned patent applications are hereby incorporated by references herein and made a part of specification.

BACKGROUND OF THE INVENTION

Field of the Invention

The disclosure relates to a centrifugal fan and, more specifically, to a centrifugal fan with an air guiding structure.

Description of the Related Art

With the miniaturization trend of various electronic devices, such as notebook, the space for a heat dissipating fan is limited. Consequently, the wind drag of the heat dissipating fan in operation is obviously increased while the performance of the fan is decreased.

BRIEF SUMMARY OF THE INVENTION

According to an aspect of the disclosure, a centrifugal fan is provided. The centrifugal fan comprises: a housing, including an upper cover and a lower cover; an impeller including a hub, the impeller is configured in the housing and configured to rotate around a rotation axis; a plurality of blades, connected to a peripheral surface of the hub; and at least one air guiding structure connected to the blades, an angle between the air guiding structure and the rotation axis increases along with a distance in the direction away from the hub.

DETAILED DESCRIPTION OF THE EMBODIMENTS

Figure 1:
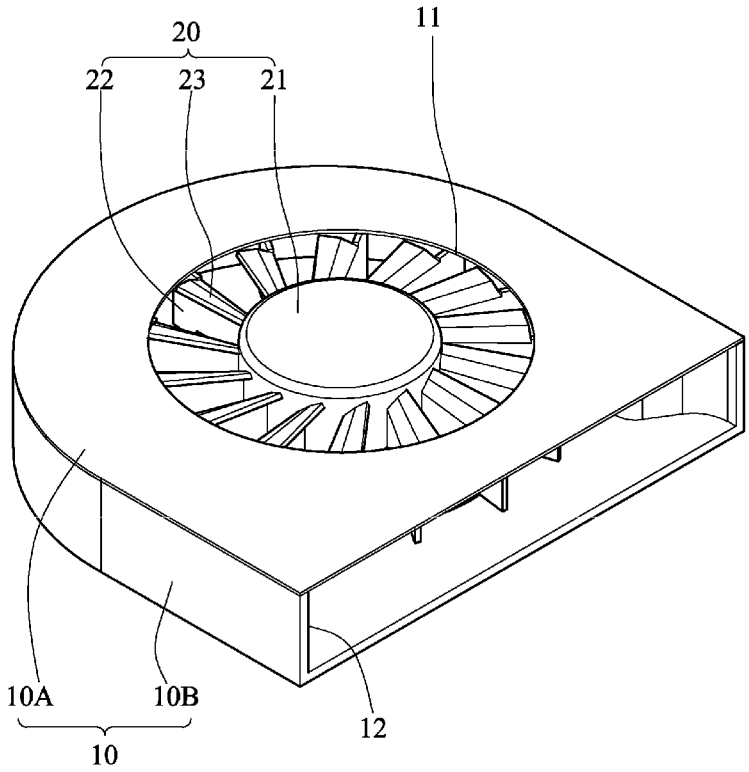
FIG. 1 is a perspective external view of a centrifugal fan of an embodiment.
Figure 2:
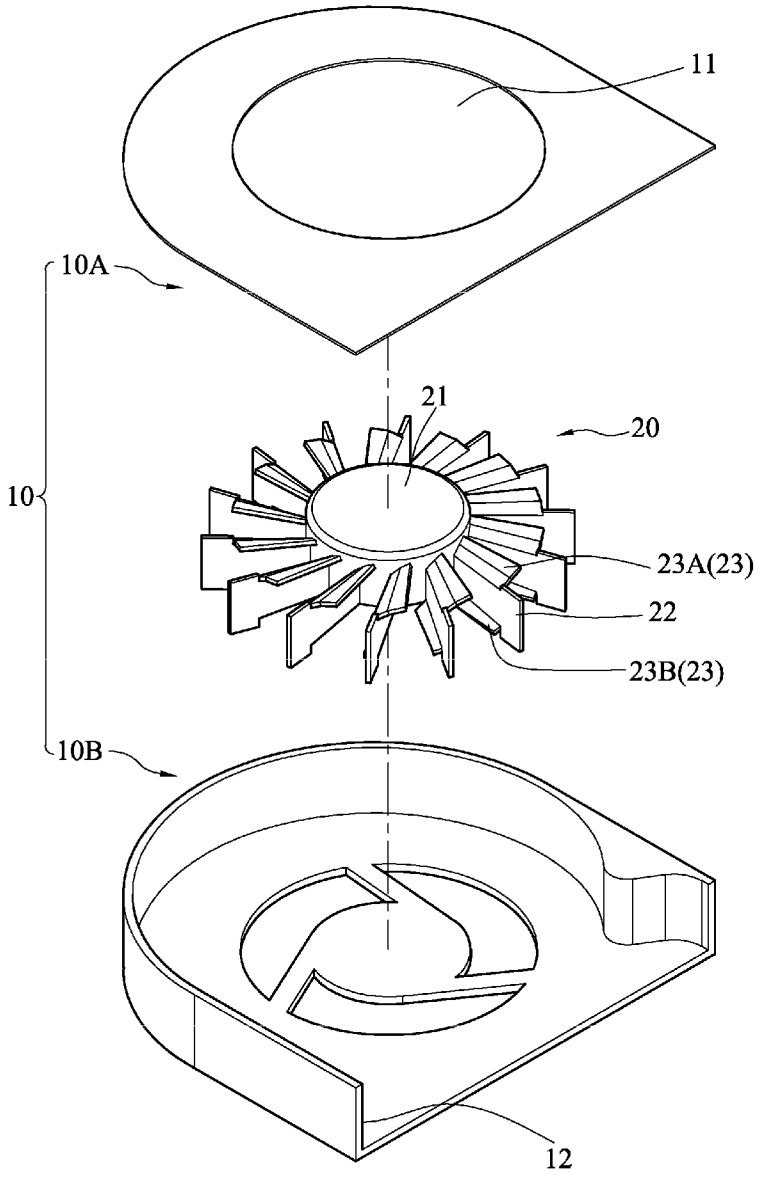
FIG. 2 is a structure exploded view of a centrifugal fan of an embodiment.

FIG. 1 is a perspective external view of a centrifugal fan of an embodiment. FIG. 2 is a perspective exploded view of a centrifugal fan of an embodiment. The centrifugal fan shown in FIG. 1 and FIG. 2 includes a housing 10 and an impeller 20.

The housing 10 includes an upper cover 10A and a lower cover 10B. The upper cover 10A is in a planar structure and includes an air inlet 11. The lower cover 10B includes a volute recess. An air outlet 12 is configured at a side of the housing 10. The impeller 20 is pivoted in the housing 10 via a hub 21. Blades 22 are configured at the peripheral surface of the hub 21. The blade 22 includes an air guiding structure 23. When the impeller 20 rotates in the housing 10, airflow flows into the housing 10 from the air inlet 11 and flows out of the air outlet 12 through blades 22 via a centrifugal force produced by rotation of the impeller 20.

Figure 3:
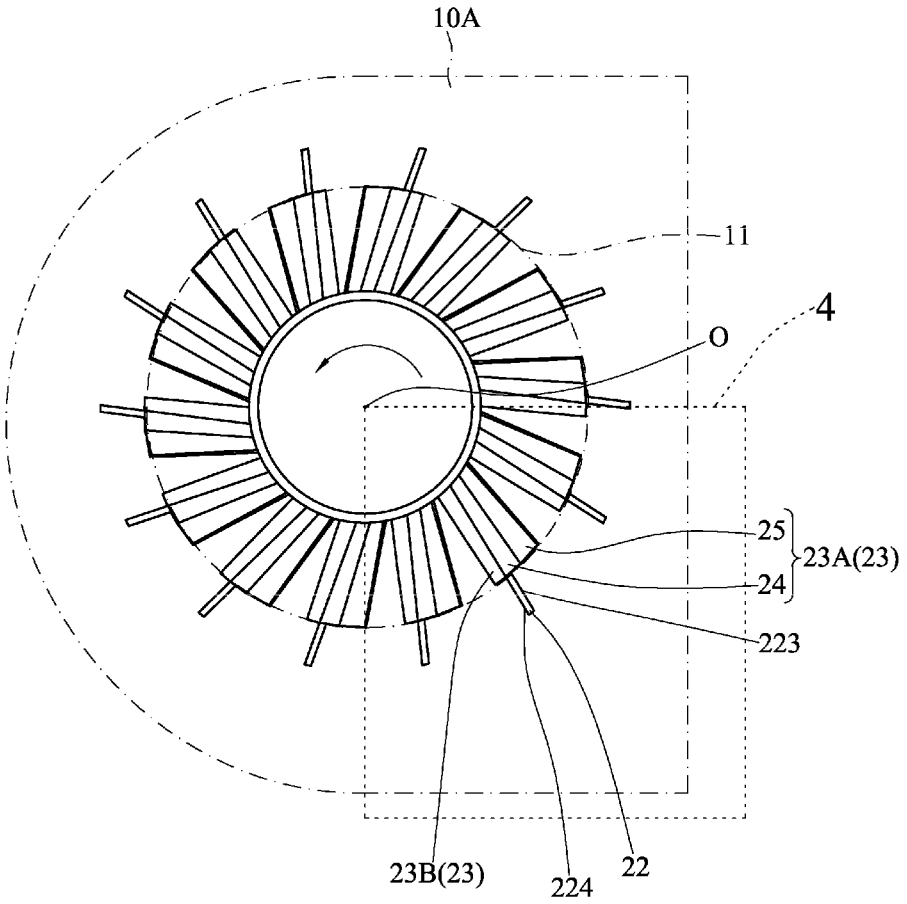
FIG. 3 is a planar view of a centrifugal fan of an embodiment.
Figure 4:
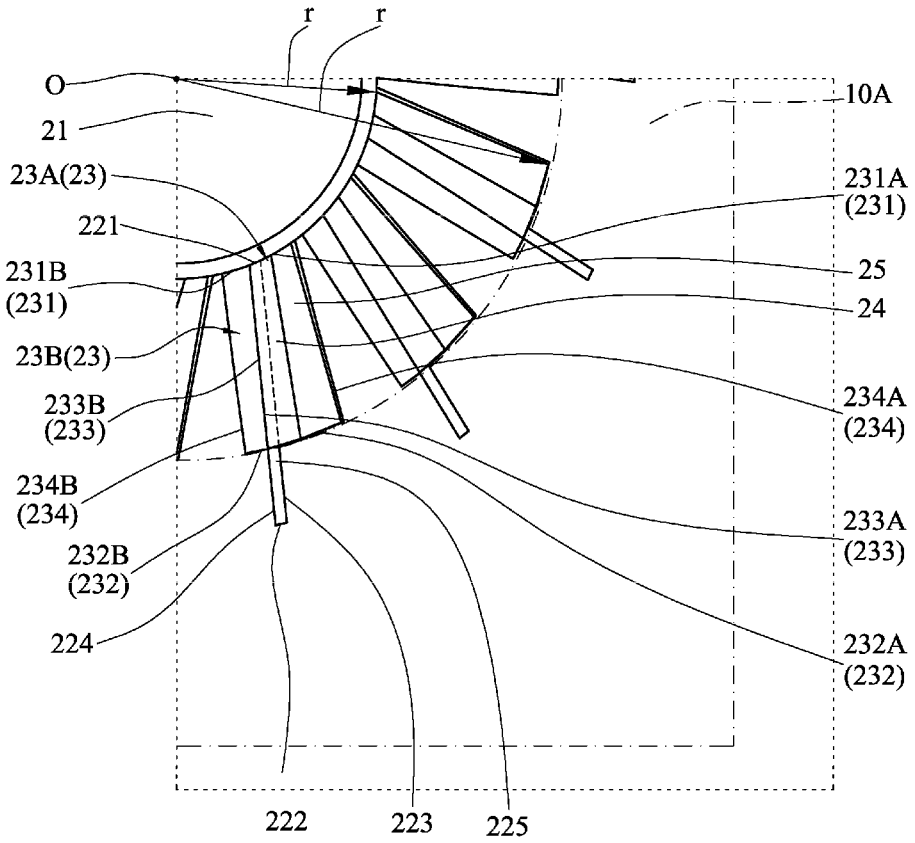
FIG. 4 is a partial view of the centrifugal fan in FIG. 3.

FIG. 3 is a top view of a centrifugal fan in an assembled state in an embodiment. FIG. 4 is a partial view of the centrifugal fan in FIG. 3. In the embodiment, the radius r is defined as the distance from a position of the air guiding structure 23 to the center O of the impeller 20, which is proportional to an air deflecting angle θ at the position. In the embodiment, the angle of the air guiding structure 23 is changed along with the change of the radius r of the air guiding structure 23. Thus, the angle that airflow flows into the impeller 20 is changed gradually with the change of tangential velocity. Therefore, turbulence generated by airflow around the blades 22 is decreased, and the noise generated by the fan in operation is also decreased.

In the embodiment, the blade 22 includes a first end 221 and a second end 222. The first end 221 is connected to the peripheral surface of the hub 21. The distance from the first end 221 to the center O of the hub 21 is smaller than the distance from the second end 222 to the center O of the hub 21. When the impeller 20 rotates, airflow flows into the housing 10 from the air inlet 11 of the upper cover 10A and flows out of the housing 10 from the air outlet 12 through the second ends 222.

The blade 22 includes a windward side 223 and a leeward side 224. The windward side 223 and the leeward side 224 are configured between the first end 221 and the second end 222. In the embodiment, the windward side 223 is parallel to the leeward side 224. The curvature of any point on the windward side 223 and the leeward side 224 is zero. As shown in FIG. 3, when the impeller 20 rotates anticlockwise, the side of the blade 22 facing the rotation direction is the windward side 223, and the other side is the leeward side 224.

Figure 5:
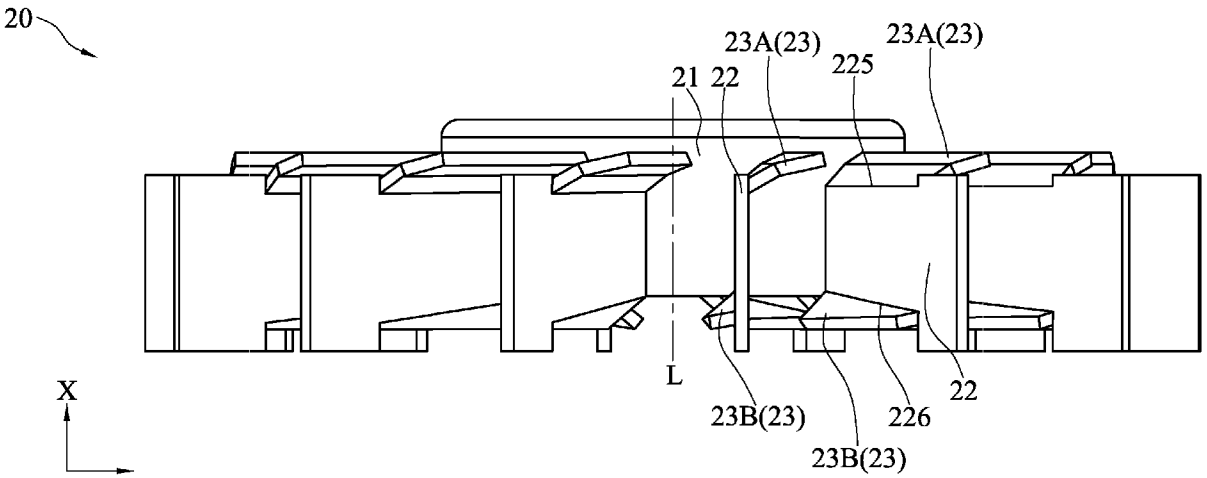
FIG. 5 is a side view of the centrifugal fan in FIG. 1.
Figure 6:
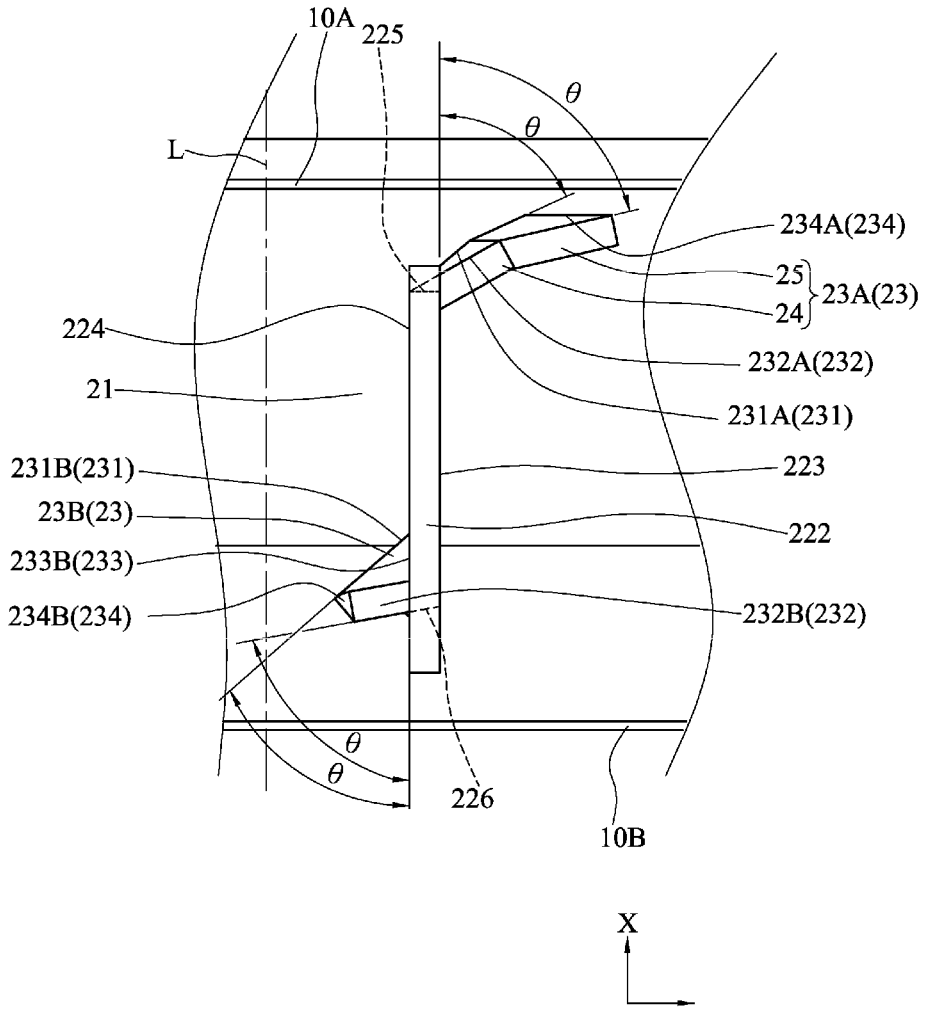
FIG. 6 is a partial view of the centrifugal fan in FIG. 5.

FIG. 5 is a side view of the centrifugal fan in FIG. 1. FIG. 6 is a partial view of the centrifugal fan in FIG. 5. In the embodiment, the blade 22 includes an upper side portion 225 and a lower side portion 226. The upper side portion 225 is close to the upper cover 10A, and the lower side portion 226 is close to the lower cover 10B.

In an embodiment, an upper air guiding structure 23A is configured at the upper side portion 225 of the blades 22. In an embodiment, the lower air guiding structure 23B is configured at the lower side portion 226. In an embodiment, an upper air guiding structure 23A is configure at the upper side portion 225 while the lower air guiding structure 23B is configured at the lower side portion 226. An upper air guiding structure 23A or the lower air guiding structure 23B is configured adjacent to the air inlet 11 to guide airflow into the impeller 20 more fluently.

In FIGS. 1 to 6, the upper air guiding structure 23A is configured at the upper side portion 225, and the lower air guiding structure 23B is configured at the lower side portion 226 of the blades 22. The air guiding structure 23 is connected to the windward side 223. An angle is formed between the air guiding structure 23 and the windward side 223. In an embodiment, the air guiding structure 23 extends towards a direction away from the windward side. In an embodiment, the air guiding structure 23 is connected to the leeward side 224. An angle is formed between the air guiding structure 23 and the leeward side 224. The air guiding structure 23 extends towards a direction away from the lee ward side. In the embodiment, the upper air guiding structure 23A and the lower air guiding structure 23B are configured at each blade 22 of the impeller 20 to make the impeller 20 balance.

The air guiding structure 23 includes an inner end 231, an outer end 232, a connection side 233 and an end part 234. The inner end 231 is connected to the peripheral surface of the hub 21. The distance from the inner end 231 to the center O of the hub 21 is smaller than the distance from the outer end 232 to the center O of the hub 21. The connection side 233 and the end part 234 are between the inner end 231 and the outer end 232. The connection side 233 extends from the blade 22 to the end part 234 in the direction away from the blade 22. The distances from any points on the air guiding structure 23 to the center O of the hub 21 along the connection direction from the inner end 231 to the outer end 232 are different. The radiuses r, which are from the points to the center O of the hub 21 along the connection direction from the inner end 231 to the outer end 232, are different.

In an embodiment, the outer end 232 of the air guiding structure 23 is in the range of the outline of the air inlet 11. Then, airflow is guided by the air guiding structure 23 when the airflow flows into the housing 10 via the air inlet 11. The tangential velocity of the end part 234 of the air guiding structure 23 relates to the performance of the fan. Consequently, the larger the tangential velocity of end part 234 is, the higher the wind velocity is. The tangential velocity is in positive correlation with radius and angular velocity. The angular velocity relates to the angle at which airflow contacts the end part 234.

In the embodiment, since air deflecting angles of positions on the end part 234 are gradually changed, airflow is guided continuously and gradually. The radius r is the distance from a point on the end part 234 to the center O of the hub 21. The air deflecting angle θ is the angle between the tangential direction of any point on the end part 234 and the axial direction X. In the embodiment, the air deflecting angle θ of the upper air guiding structure 23A is the angle between the tangential direction of any point on the end part 234A and the axial direction X towards a side of the upper cover 10A. The air deflecting angle θ of the lower air guiding structure 23B is the angle between the tangential direction of any point on the end part 234B and the axial direction X towards a side of the lower cover 10B.

The radius r of a point on the end part 234 of the air guiding structure 23 is proportional to the air deflecting angle θ at the same position. Therefore, the shorter the distance from the end part 234 of the air guiding structure 23 to the center O of the hub 21 is, the smaller the air deflecting angle θ is, and vice versa. The air deflecting angle θ of the end part 234 of the air guiding structure 23 is gradually changed in proportional to the radius r.

When the impeller 20 rotates, airflow flows into the impeller 20 from the air inlet 11. Airflow is guided gradually from the inner end 231 of the air guiding structure 23 to the outer end 232 via the air guiding structure 23. In the circumstance that tangential velocities are changed, airflows are guided in different airflow inlet angles. Thus, the fluency of the airflow is increased, and the energy loss is decreased.

With the configuration of the air deflecting angle θ, the appearance of the air guiding structure 23 are various. In the embodiments in FIGS. 1 to 6, the upper air guiding structure 23A has a planar structure in which the curvature of any point from the connection side 233A to the end part 234A is zero. The lower air guiding structure 23B also has a planar structure in which the curvature of any point from its connection side 233B to the end part 234B is zero. Moreover, the lower air guiding structure 23B includes a single plane. The upper air guiding structure 23A includes a first plane 24 and a second plane 25. The first plane 24 of the upper air guiding structure 23A is connected to the blade 22. The second plane 25 is connected to the first plane 24. An angle is formed between the first plane 24 and the second plane 25. In the embodiment, the end part 234A of the upper air guiding structure 23A is an end fringe of the second plane 25, and the end part 234B of the lower air guiding structure 23B is an end fringe of the lower air guiding structure 23B. The end fringe in the embodiment refers to the end away from the blade 22.

Figure 7B:
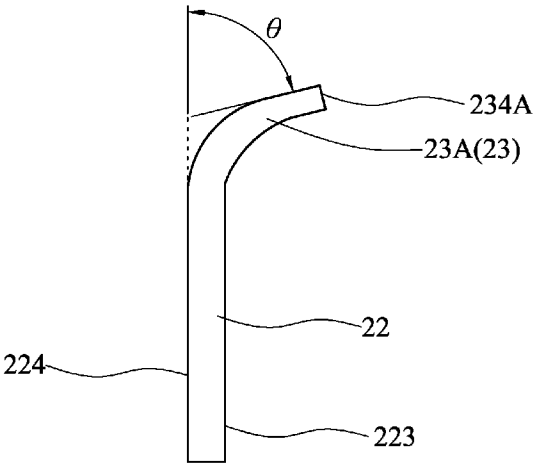
FIGS. 7A~7B are schematic views of an upper air guiding structure of a blade of an impeller of a centrifugal fan of other embodiments.
Figure 7A:
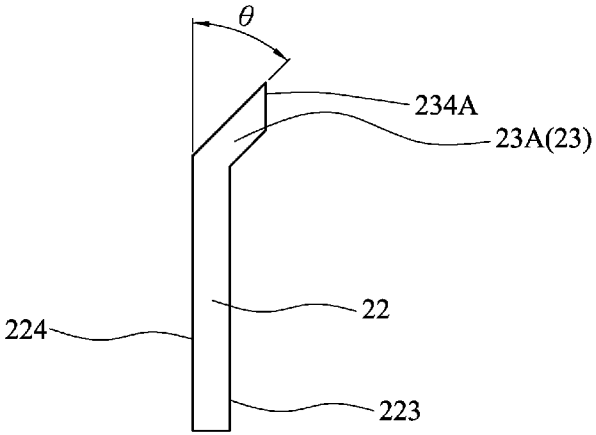

In FIG. 7A to FIG. 7B, the upper air guiding structure 23A extends from the windward side 223 towards the direction having an angle with the windward side 223. In the embodiment shown in FIG. 7A, the plane structure of the upper air guiding structure 23A is one. In the embodiment shown in FIG. 7B, at least part of the upper air guiding structure 23A between the blade 22 and the end part 234A has a curvature whose value is not zero.

Figure 8:
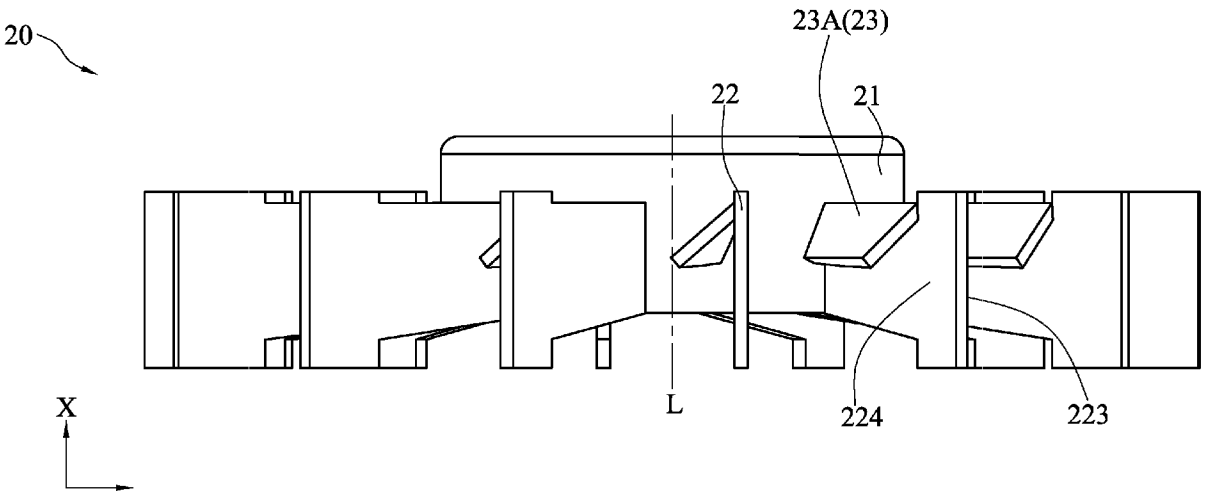
FIG. 8 is a schematic view of an upper air guiding structure of a blade of an impeller of a centrifugal fan in an embodiment.

The configuration of the upper air guiding structure 23A is not limited to extend from the windward side 223 in the direction having an angle with the windward side 223. In an embodiment shown in FIG. 8, the upper air guiding structure 23A extends from the leeward side 224 in the direction having an angle with the leeward side 224. In the embodiment, the upper air guiding structure 23A is configured, and the lower air guiding structure is not configured. In this embodiment, the air deflecting angle θ of the air guiding structure 23 connected to the leeward side 224 is the angle between the tangential direction of a position of the end part 234 and the axial direction X facing the side of the lower cover 10B.

Figure 9B:
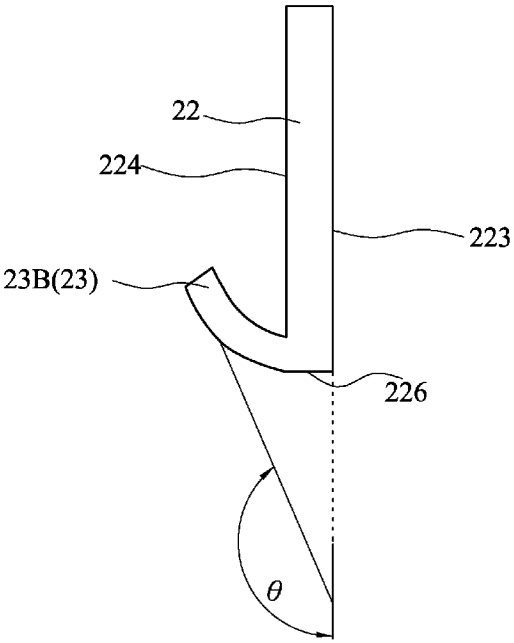
FIGS. 9A~9B are schematic views of a lower air guiding structure of a blade of an impeller of a centrifugal fan in an embodiment.
Figure 9A:
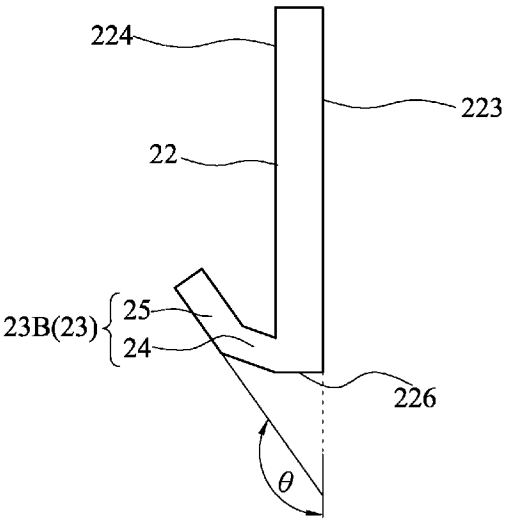

In the embodiment shown in FIG. 9A, an angle is formed between the lower air guiding structure 23B and the leeward side 224. The lower air guiding structure 23B extends in the direction away from the leeward side 224. The lower air guiding structure 23B includes the first plane 24 and the second plane 25. In the embodiment shown in FIG. 9B, an angle is formed between the lower air guiding structure 23B and the leeward side 224. The lower air guiding structure 23B extends in the direction away from the leeward side 224. In FIG. 9B, the lower air guiding structure 23B is a curved structure. In embodiments, whether the upper air guiding structure 23A and/or the lower air guiding structure 23B is configured at the blade 22, the upper air guiding structure 23A and the lower air guiding structure 23B having the appearance in above embodiments can be configured, which is not limited herein.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

What is claimed is:

1. A centrifugal fan, comprising:

a housing, including an upper cover and a lower cover;

an impeller including a hub, the impeller is configured in the housing and configured to rotate around a rotation axis;

a plurality of blades, connected to a peripheral surface of the hub; and at least one air guiding structure connected to the blades, an angle between the air guiding structure and the rotation axis increases along with a distance in the direction away from the hub, the air guiding structure includes a connection side and an end part opposite to the connection side, the connection side is connected to the blade, and the end part is configured at a position farther away from the blade in comparison with the connection side.

2. The centrifugal fan according to claim 1, wherein the blade includes a windward side and a leeward side, and the air guiding structure is connected to the windward side or the leeward side.

3. The centrifugal fan according to claim 2, wherein the blade further includes an upper side portion and a lower side portion, the upper side portion is close to the upper cover, the lower side portion is close to the lower cover, and the air guiding structure is connected to the upper side portion or the lower side portion.

4. The centrifugal fan according to claim 1 wherein a radius is the distance from a point on the end part of the air guiding structure to a center of the hub, an air deflecting angle is formed between a point on the end part and the radius, the radius of a point on the end part is proportional to the air deflecting angle of the point.

5. The centrifugal fan according to claim 1, wherein the air guiding structure extends in the direction away from the windward side, and an angle is formed between the air guiding structure and the windward side.

6. The centrifugal fan according to claim 1, wherein the air guiding structure extends in the direction away from the leeward side, and an angle is formed between the air guiding structure and the leeward side.

7. The centrifugal fan according to claim 1, wherein curvature of any point between the connection side and the end part of the air guiding structure is zero.

8. The centrifugal fan according to claim 1, wherein the air guiding structure includes a first plane and a second plane, the first plane is connected to the blade, the second plane is connected to the first plane, and curvature of any point on the first plane and the second plane is zero.

9. The centrifugal fan according to claim 1, wherein the air guiding structure is a curved structure.

* * * * *